US011495105B2

(12) United States Patent
Ruwaili et al.

(10) Patent No.: US 11,495,105 B2
(45) Date of Patent: Nov. 8, 2022

(54) SOLAR PANEL EFFICIENCY AND SECURITY MONITORING DEVICE

(71) Applicant: Saudi Arabian Oil Company, Dhahran (SA)

(72) Inventors: Ayed A Ruwaili, Riyadh (SA); Abdulaziz H Saiyari, Riyadh (SA); Khalid H Qahtani, Riyadh (SA); Abdulaziz A Alonazi, Riyadh (SA); Muath M Khaldi, Riyadh (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/193,559

(22) Filed: Mar. 5, 2021

(65) Prior Publication Data

US 2022/0284784 A1 Sep. 8, 2022

(51) Int. Cl.
*G08B 13/24* (2006.01)
*G08B 25/10* (2006.01)
(Continued)

(52) U.S. Cl.
CPC ..... *G08B 13/248* (2013.01); *G08B 3/10* (2013.01); *G08B 13/19* (2013.01);
(Continued)

(58) Field of Classification Search
CPC ..... H02S 20/32; B64G 1/443; B64G 1/503; B64G 1/446; Y02E 10/52; H02J 3/383
See application file for complete search history.

(56) References Cited

U.S. PATENT DOCUMENTS 4,101,876 A * 7/1978 Lurkis ..... G08B 13/1481 340/568.8
6,650,031 B1 11/2003 Goldack
(Continued)

FOREIGN PATENT DOCUMENTS

EP 2513879 B1 11/2013

OTHER PUBLICATIONS

Al-Dahoud et al., "Improving Monitoring and Fault Detection of Solar Panels Using Arduino Mega in WSN", London United Kingdom, vol. 13, No. 3, Part VII, Mar. 14-15, 2015.
(Continued)

*Primary Examiner* — Mirza F Alam
(74) *Attorney, Agent, or Firm* — Dinsmore & Shohl LLP

(57) ABSTRACT

A system for monitoring efficiency and security of a solar array includes a voltage-based monitoring circuit and a photoelectric sensor. The system detects a voltage across the solar array and compares the voltage to changes in light detected by the photoelectric sensor. In response to reduced light detected at the photoelectric sensor, the system generates a low-efficiency alarm. In response to reduced voltage while light detected by the photoelectric sensor remains constant, the system generates a security alarm signal. The system may also include a PIR sensor, an RFID reader, and a solar panel circuit including the solar panels of the solar array. In response to an infrared alarm at the PIR sensor, an unauthorized alarm at the RFID reader, and an open circuit alarm signal of the solar panel circuit, and the security alarm signal, the system may transmit a master alarm to a monitoring center.

13 Claims, 4 Drawing Sheets

(51) Int. Cl.

| | |
|---|---|
| ***G08B 13/19*** | (2006.01) |
| ***G08B 13/196*** | (2006.01) |
| ***G08B 3/10*** | (2006.01) |

(52) U.S. Cl.
CPC ... *G08B 13/1966* (2013.01); *G08B 13/19636* (2013.01); *G08B 13/2417* (2013.01); *G08B 25/10* (2013.01)

(56) References Cited

U.S. PATENT DOCUMENTS

| | | | | |
|---|---|---|---|---|
| 7,859,404 | B2 | 12/2010 | Lee et al. | |
| 8,736,449 | B2 | 5/2014 | Sacchetti | |
| 10,601,363 | B1 * | 3/2020 | Rubin | H02S 20/23 |
| 2010/0141424 | A1 | 6/2010 | Coloma Calahorra et al. | |
| 2013/0314236 | A1 * | 11/2013 | Warren | G08B 21/182 340/635 |
| 2016/0027269 | A1 | 1/2016 | Trundle et al. | |
| 2016/0155318 | A1 * | 6/2016 | Caine | H02S 50/00 340/635 |

OTHER PUBLICATIONS

Baratchi et al., "Sensing Solutions for Collecting Spatio-Temporal Data for Wildlife Monitoring Applications: A Review", Sensors, vol. 13, pp. 6054-6088, ISSN 1424-8220, 2013.

Damarla, "Robust Personnel Detection using PIR and Seismic Sensors", US Army Research Laboratory, Oct. 2012.

Dragulinescu et al., "Sensors system design for discrimination between human and animals", SPIE Proceedings Publications, Conference Paper, Dec. 2016.

Hong et al., "Reduction of False Alarm Signals for PIR Sensor in Realistic Outdoor Surveillance", ETRI Journal, vol. 35, No. 1, Feb. 2013.

Jisha et al., "Intruder Tracking Using Wireless Sensor Network", IEEE, 978-1-4244-4967-4/10, 2010.

Shwetha et al., "Passive Infrared (PIR) Sensor Based Security Control System using Microcontroller using 89C51", Dr. Ambedkar Institute of Technology, Proceedings of CCSO, ISBN 978-93-82338-56-7, 2013.

Zhao, "Faul Tetection, Classification and Protection in Solar Photovoltaic Arrays", Dissertation, Northeastern University, Aug. 2015.

* cited by examiner

SOLAR PANEL EFFICIENCY AND SECURITY MONITORING DEVICE

TECHNICAL FIELD

The present specification generally relates to electronic security monitoring systems and, more specifically, systems and methods for monitoring solar panel efficiency and security.

BACKGROUND

As solar panels become more cost-effective, solar panel arrays are becoming more widely used for power generation. These solar panel arrays require a large amount of space and may be deployed in remote regions in order to maximize sunlight exposure. It is important to be able to monitor and maintain the operating efficiency of solar panel arrays, identify and repair or replace damaged solar panels, and prevent theft of solar panels or electricity from solar arrays. However, monitoring efficiency, health, and security of solar panel arrays may be difficult in locations that are isolated and remote.

Accordingly, a need exists for alternative systems and methods for monitoring solar panel efficiency and security.

SUMMARY

In a first aspect of a first embodiment, the disclosed embodiments, a solar panel monitoring system may include a photoelectric sensor configured to detect a light level at a solar panel, and a voltage-based monitoring circuit configured to receive a detected light level from the photoelectric sensor, monitor a voltage of the solar panel, and generate a security alarm signal in response to detecting a reduced voltage of the solar panel while the detected light level from the photoelectric sensor remains constant. The solar panel monitoring system may further include a solar panel circuit configured to form a closed circuit with the solar panel such that removal of the solar panel opens the closed circuit and generates an open circuit alarm signal, a PIR sensor configured to output an infrared alarm signal in response to detecting an infrared signal exceeding a predetermined threshold, an RFID reader configured to detect an authorized RFID tag and generate an unauthorized alarm signal in response to a failure to detect an authorized RFID tag, and a processor. The processor may be configured to, in response to detecting both the security alarm signal and the open circuit alarm signal, check the output of the PIR sensor. In response to the infrared alarm signal output by the PIR sensor, the processor may detect the unauthorized alarm signal and, in response to detecting the unauthorized alarm signal, transmit a master alarm to a monitoring center.

In a second aspect, based on the first aspect of the first embodiment, the voltage-based monitoring circuit is further configured to generate a low-efficiency alarm in response to detecting the reduced voltage of the solar panel and a reduced detected light level from the photoelectric sensor, and the processor is further configured to transmit the low-efficiency alarm to the monitoring center.

In a third aspect, based on any of the preceding aspects of the first embodiment, the voltage-based monitoring circuit is further configured to check the detected light level from the photoelectric sensor in response to the detecting of the reduced voltage of the solar panel, generate the low-efficiency alarm in response to a reduced detected light level, and generate the security alarm signal in response to the detected light level remaining constant while detecting the reduced voltage of the solar panel.

In a fourth aspect, based on any of the preceding aspects of the first embodiment, the solar panel monitoring system may further include a camera, and the processor is further configured to record images using the camera in response to the infrared alarm signal and detecting the unauthorized alarm signal.

In a fifth aspect, based on any of the preceding aspects of the first embodiment, the solar panel monitoring system may further include a siren, and the processor is further configured to activate the siren in response to the infrared alarm signal and detecting the unauthorized alarm signal.

In a sixth aspect, based on any of the preceding aspects of the first embodiment, the solar panel monitoring system may further include a solar panel regulator configured to connect to the solar panel, and the voltage-based monitoring circuit is embedded in the solar panel regulator.

In a first aspect of a second embodiment, a solar panel monitoring method may include receiving a detected light level from a photoelectric sensor positioned at the solar array, detecting a reduced voltage of the solar array, and receiving an open circuit alarm signal of a solar panel circuit configured to form a closed circuit with the solar array. In response to receiving the open circuit alarm signal and detecting the reduced voltage of the solar panel while the detected light level from the photoelectric sensor remains constant the method may include detecting an infrared alarm signal of a PIR sensor, reading an unauthorized alarm signal of an RFID reader in response to detecting the infrared alarm signal output by the PIR sensor, and transmitting a master alarm to a monitoring center in response to reading the unauthorized alarm signal.

In a second aspect, based on the first aspect of the second embodiment, the method may further include transmitting a low-efficiency alarm to the monitoring center in response to detecting the reduced voltage of the solar panel and a reduced detected light level from the photoelectric sensor.

In a third aspect, based on any of the preceding aspects of the second embodiment, the method may further include checking the detected light level from the photoelectric sensor in response to the detecting of the reduced voltage of the solar panel, generating the low-efficiency alarm in response to a reduced detected light level, and generating a security alarm signal in response to detecting the reduced voltage of the solar panel while the detected light level from the photoelectric sensor remains constant.

In a fourth aspect, based on any of the preceding aspects of the second embodiment, the solar panel monitoring method may further include recording images using a camera in response to the infrared alarm signal and detecting the unauthorized alarm signal.

In a fifth aspect, based on any of the preceding aspects of the second embodiment, the solar panel monitoring method may further include activating a siren in response to the infrared alarm signal and detecting the unauthorized alarm signal.

In a sixth aspect, based on any of the preceding aspects of the second embodiment, the solar panel monitoring method may further include using a PIR sensor to detect an infrared signal greater than or equal to a threshold corresponding to a human infrared signal, and generating the infrared alarm signal in response to detecting the infrared signal.

In a seventh aspect, based on any of the preceding aspects of the second embodiment, the solar panel monitoring method may further include using an RFID reader to scan for an RFID tag of an authorized user, and generating the unauthorized alarm signal in response to failure to detect the RFID tag of the authorized user.

Further embodiments may include non-volatile computer readable media storing instructions which cause a processor to execute process steps of one or more of the aspects of the disclosed methods.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Solar panel arrays (solar arrays) may be installed at remote locations to reduce real estate costs and increase sunlight exposure. At remote solar panel arrays, security is often maintained through in-person patrols. It can be difficult and expensive to maintain in-person security presence 24/7. Although additional security measures may be taken, such as fencing and locks, solar arrays omit rooftops in order to allow exposure to direct sunlight, so the security afforded by a partial enclosure is limited. Thus, remote solar arrays are often vulnerable to theft.

In addition, remote solar arrays may be subject to performance degradation and component failure which may lead to reduced solar array efficiency. The disclosed embodiments relate to systems and methods for remote monitoring of solar panel array efficiency and security.

Figure 1:
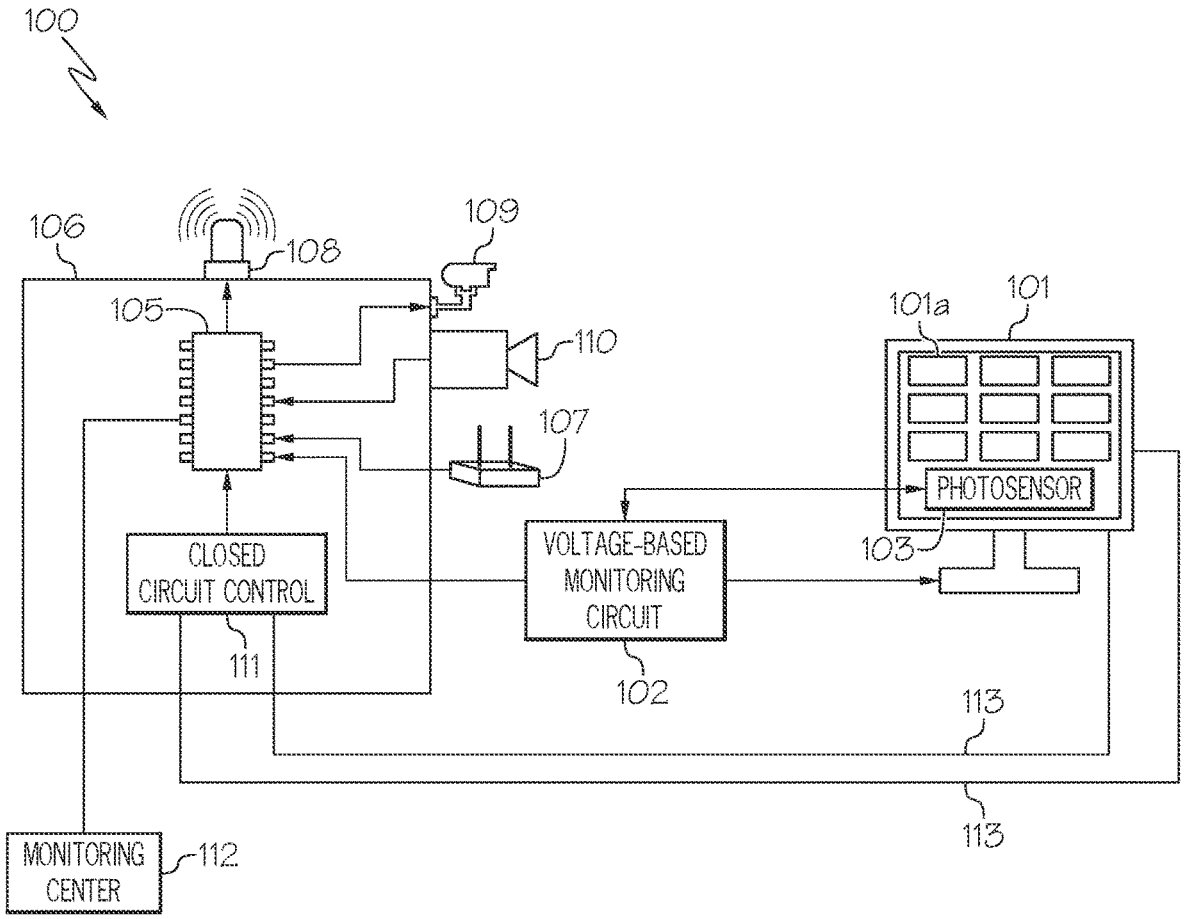
FIG. 1 depicts a system for monitoring solar panel efficiency and security according to one or more embodiments shown and described herein.

Referring now to FIG. 1, a solar array monitoring system 100 is depicted according to one or more embodiments shown and described herein. The solar array monitoring system 100 comprises a solar panel array (solar array) 101, a voltage-based monitoring circuit 102, and a processor 105. The solar array 101 may include one or more solar panels 101*a*. The processor 105 may be configured to monitor one or more components of the solar array monitoring system 100 and transmit a master alarm to a monitoring center 112 in response to detecting one or more alarm signals generated by the components of the solar array monitoring system 100. The voltage-based monitoring circuit 102 is configured to monitor a voltage of the solar array 101. The voltage of the solar array 101 may comprise a voltage measured across the solar array 101 relative to an electrical ground. According to some embodiments, the solar array 101 monitoring system may include a photoelectric sensor 103 positioned at the solar array 101 and connected to the voltage-based monitoring circuit 102. The photoelectric sensor 103 may be configured to detect light intensity or a light level at the solar panel array 101.

The solar array monitoring system 100 may further comprise a solar panel circuit 113 including the solar panels 101*a*, and a closed circuit control 111 configured to monitor the solar panel circuit 113. The solar array monitoring system 100 may further comprise an RFID reader 107 for identifying authorized users, a passive infrared (PIR) sensor 110 configured to detect the presence of a human while ignoring the presence of small animals, a closed-circuit TV (CCTV) camera 109, and a siren 108. One or more components of the solar array monitoring system 100 may be enclosed in a communications shelter 106. The communications shelter may comprise any enclosure that prevents tampering with solar array monitoring system 100 components.

The voltage-based monitoring circuit 102 may be configured to receive a detected light level from the photoelectric sensor 103 (photoelectric signal). The detected light level may include an electrical signal, from the photoelectric sensor 103, that indicates intensity of light incident on the photoelectric sensor 103. The photoelectric sensor 103 may comprise any device capable of modifying an electrical signal in response to changing intensity of light incident on the photoelectric sensor, including a device which changes resistance in response to changes in intensity of light incident on the photoelectric sensor. As a non-limiting example, the photoelectric sensor may comprise a photoresistor. A photoresistor may include a device that decreases resistance in response to increasing intensity of light incident on the photoresistor. When no light is incident on the photoresistor, a voltage drop measured across the photoresistor may be at a maximum, as resistance is at a maximum. As light intensity is increased, the voltage drop measured across the photoresistor decreases, as resistance decreases. According to some embodiments, the electrical signal may be at a maximum when bright sunlight is incident on the photoelectric sensor 103 and the electrical signal may be an a minimum when no light is incident on the photoelectric sensor 103.

The voltage-based monitoring circuit is configured to generate a low-efficiency alarm in response to the detected light level from the photoelectric sensor 103 being below an efficiency threshold. The processor may transmit the low-efficiency alarm to a monitoring center 112. Depending on the type of photoelectric sensor 103 used, efficiency may be directly proportional to the electrical signal received from the photoelectric sensor 103 or inversely proportional to the electrical signal received from the photoelectric sensor 103. According to some embodiments, the efficiency threshold may be halfway between the maximum of the electrical signal and the minimum of the electrical signal, 75% of the maximum of the electrical signal, or 25% of the maximum electrical signal. The efficiency threshold may be determined based on an amount of sunlight that is typical for the location where the solar array 101 is deployed. The efficiency threshold may be determined, in part, based on a performance level required or desired for the solar panel array. The efficiency threshold may be customized, as appropriate for the solar array 101 facility location, based on user input. A person of ordinary skill in the art will be able to determine an appropriate efficiency threshold given the performance requirements and typical sunlight at the location where the solar array 101 is deployed.

The voltage-based monitoring circuit 102 is configured to monitor a voltage across the solar panels of the solar array

101. The voltage across the solar panel array 101 may fluctuate based on the intensity of sunlight incident on the solar panel array 101. The voltage across the solar panel array 101 may also decrease if one or more of the solar panels 101*a* is disconnected or removed from the solar panel array 101. Disconnection or removal of a solar panel 101*a* from the solar panel array may be an indicator of theft.

The voltage-based monitoring circuit 102 is configured to detect a reduced voltage across the solar panel array 101 and, in response to the reduced voltage, check the detected light level from the photoelectric sensor 103 to determine whether the reduced voltage across the solar panel array may be attributed to reduced light intensity. In response to an electrical signal from the photoelectric sensor 103 corresponding to a reduced detected light level, the voltage-based monitoring circuit may generate a low-efficiency alarm. In response to the voltage across the solar panel array 101 being reduced while the detected light level from the photoelectric sensor remains constant, the voltage-based monitoring circuit 102 may generate a security alarm signal. Because shadows from clouds, birds, or the surrounding environment may momentarily interrupt sunlight to the photoelectric sensor 103, the term "remain constant" and variants thereof is intended to encompass some fluctuation of the photoelectric signal. Even if the signal from the photoelectric sensor 103 fluctuates during a time period that a reduction in voltage across the solar array 101 is detected, so long as the signal from the photoelectric sensor 103 returns to substantially the same value maintained before the fluctuation, the signal from the photoelectric sensor can be considered to remain constant.

As an example for illustration purposes only, in bright sunlight, the electrical signal from the photoelectric sensor 103 may be 1 volt, while the voltage across the solar panel array 101 may be 20 volts. In response to the voltage across the solar panel array being reduced to 15 volts while the electrical signal from the photoelectric sensor 103 remains at 1 volt, the voltage-based monitoring circuit may generate a security alarm signal, as the reduction in voltage while the sunlight intensity remains constant may indicate that one or more solar panels 101*a* has been disconnected or removed. The voltage-based monitoring circuit may also generate a security alarm signal in response to reduced voltage across the solar array while the detected light level from the photoelectric sensor indicates an increase in light intensity.

In response to detecting a decreased voltage across the solar panel array, the voltage-based monitoring circuit 102 may check the detected light level from the photoelectric sensor 103 to verify if the cause is based on lower light received. If the detected light level of the photoelectric sensor 103 has remained constant or increased over the period of time that the voltage across the solar panel array has decreased, the voltage-based monitoring circuit 102 generates a security alarm signal.

According to some embodiments, the solar array monitoring system 100 may include a solar panel circuit 113 and a closed circuit control 111. The solar panel circuit 113 passes through all solar panels 101*a* of the solar array 101 forming a closed circuit that includes each of the solar panels 101*a* of the solar array 101. The solar panel circuit 113 is configured such that removal of any of the solar panels 101*a* causes the closed circuit to be opened. According to some embodiments, the solar panels 101*a* are arranged in series on the solar panel circuit 113.

The closed circuit control 111 is configured to generate an open circuit alarm signal in response to the solar panel circuit 113 being opened or broken. The processor 105 is configured to monitor one or more of the closed circuit control 111 and the voltage-based monitoring circuit 102 and to activate one or more components of the solar array monitoring system 100 in response to the open circuit alarm signal or the security alarm signal.

The solar panel circuit 113 passes through each of the solar panels 101*a* in the solar panel array 101 such that a solar panel 101*a* cannot be removed without physically cutting a conductor or conductive cable that forms the solar panel circuit 113, or otherwise breaking the electrical contact that each solar panel 101*a* makes to complete the solar panel circuit 113. Therefore, a solar panel 101*a* cannot be removed without breaking or opening the solar panel circuit 113. The closed circuit control 111 is configured to monitor the solar panel circuit 113 and generate an open circuit alarm signal in response to detecting that the solar panel circuit 113 has been cut, broken, or otherwise opened.

According to some embodiments, the solar array monitoring system 100 may comprise one or more passive infrared (PIR) sensors 110. The PIR 110 sensor may include any sensor capable of passively detecting infrared radiation in the immediate environment of the solar panel array 101. The one or more PIR sensors 110 may be configured to distinguish between small animals and humans based on differences in infrared radiation emitted. According to some embodiments, the PIR sensors 110 may be configured to generate an infrared alarm signal in response to detecting a human infrared signal. PIR sensors 110, including PIR sensor 110 capable of distinguishing between humans and small animals, are readily available and a person of ordinary skill in the art will be able to select one or more appropriate PIR sensors 110 based on the characteristics of the solar panel array 101 being monitored by one or more PIR sensors 110. According to some embodiments, the processor 105 may be configured to read one or more PIR sensors 110 to detect the presence of a human at the solar panel array 101. According to some embodiments, the processor 105 may be configured to read one or more PIR sensors 110 to detect the presence of a human at the solar panel array 101 in response to detecting one or more of the security alarm signal or the open circuit alarm signal.

According to some embodiments, the solar array monitoring system 100 may comprise one or more RFID readers 107. RFID readers 107 are readily available and a person of ordinary skill in the art will be capable of selecting one or more RFID readers 107 appropriate for implementing the disclosed embodiments. According to some embodiments, the processor 105 may be configured to monitor the RFID reader 107 and receive an RFID signal indicating whether the RFID reader 107 has scanned an authorized RFID tag. The RFID reader 107 may be configured to generate an unauthorized alarm signal in response to failure to scan an authorized RFID tag. According to some embodiments, the RFID reader 107 may be configured to continuously generate an unauthorized alarm signal until an authorized RFID tag is scanned. According to some embodiments, the processor 105 may be configured to read the unauthorized alarm signal from the RFID reader 107 in response to one or more alarm signals, including, but not limited to, the security alarm signal, the low-efficiency alarm, the infrared alarm signal, and the open circuit alarm signal. In response to the RFID signal including an unauthorized alarm signal, the processor 105 may activate one or more components of the solar array monitoring system 100 and transmit a master alarm to the monitoring center.

According to some embodiments, the solar array monitoring system 100 may comprise one or more CCTV cameras 109. CCTV cameras are readily available and a person of ordinary skill in the art will be capable of selecting one or more CCTV cameras suitable for monitoring the solar panel array 101. According to some embodiments, the processor 105 may be configured to monitor one or more of the PIR sensors 110, the RFID reader 107, the voltage-based monitoring circuit 102, and the closed circuit control 111 and activate the CCTV camera 109 in response to detecting one or more of the security alarm signal, the open circuit alarm signal, the unauthorized user alarm signal, or the infrared alarm signal.

According to some embodiments, the solar array monitoring system 100 may include a siren 108. A siren 108 is well known and a person of ordinary skill in the art will be capable of selecting a siren appropriate for implementing the disclosed embodiments. According to some embodiments, the processor 105 may be configured to monitor the components of the solar array monitoring system 100 and activate the siren 108 in response to detecting one or more of the security alarm signal, the open circuit alarm signal, the unauthorized user alarm signal, or the infrared alarm signal.

According to some embodiments, the photoelectric sensor 103 may be configured to detect a light level at one or more solar panels 101*a* of the solar panel array 101. The voltage-based monitoring circuit 102 may be configured to receive the detected light level from the photoelectric sensor 103 and monitor a voltage of at least one solar panel 101*a*. The voltage-based monitoring circuit 102 may generate a security alarm signal in response to detecting a reduced voltage of the solar panel 101*a* while the detected light level from the photoelectric sensor 103 remains constant. The processor 105 may be configured to receive the infrared alarm signal, the unauthorized alarm signal, the security alarm signal and the open circuit alarm signal. In response to detecting both the security alarm signal and the open circuit alarm, the processor may check the output of the PIR sensor and, in response to detecting the infrared alarm signal output by the PIR sensor, the processor may detect the unauthorized alarm. In response to detecting the unauthorized alarm signal, the processor may transmit the master alarm to the monitoring center.

The solar array monitoring system 100 may be configured to monitor a voltage across the solar panel array 101, an electrical signal from the photoelectric sensor 103, the status of a solar panel circuit 113 that includes the solar panels 101*a*, an RFID reader 107, and a PIR sensor 110. According to some embodiments, in response to detecting the security alarm signal generated by the voltage-based monitoring circuit 102, the open circuit alarm signal generated by the closed circuit control 111, the unauthorized alarm signal from the RFID reader 107, and the infrared alarm signal generated by the PIR sensor, the processor 105 activates the CCTV camera 109 to record images of the solar array 101, activates the siren 108, and transmits a master alarm to a monitoring center 112.

Figure 2:
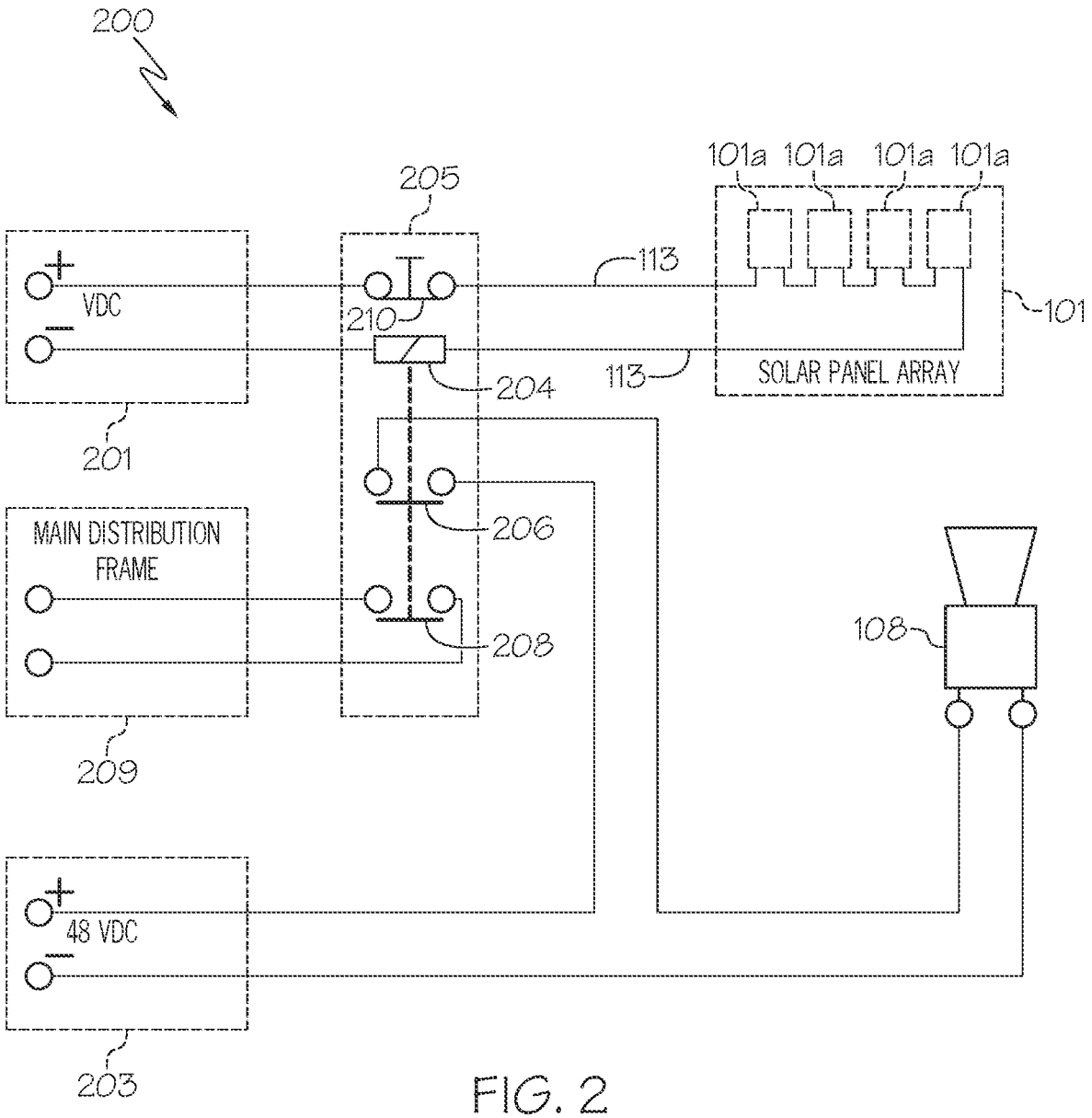
FIG. 2 depicts a circuit diagram for monitoring solar panel security according to one or more embodiments shown and described herein.

Now referring to FIG. 2, a circuit diagram for monitoring solar panel security is shown according to one or more embodiments shown and described herein. According to some embodiments, the solar panel array 101 comprises a plurality of solar panels 101*a*. A solar panel circuit 113 comprises a first power source 201 and a relay 204. The solar panel circuit 113 is completed by passing through each of the solar panels 101*a* of the solar panel array 101. The first power source 201 generates a voltage across the solar panel circuit 113 and the relay 204. The first power source 201 may comprise any DC or AC power source. AC and DC power sources are readily available, and a person of ordinary skill in the art will be capable of selecting a power source suitable for implementing the disclosed embodiments.

According to some embodiments, the relay 204 is powered by the first power source 201 and controls a signal to a main distribution frame 209 and power to a siren 108. According to some embodiments, the siren 108 is powered by a second power source 203. According to some embodiments, the second power source 203 comprises a 48 volt DC power source. According to some embodiments, the first power source 201 and the second power source 203 are separate power sources so that a loss of power at one location does not interfere with operation of the system at another location. According to some embodiments, the main distribution frame 209 comprises a central communications hub configured to send communication signals and generated alarm signals to their respective destinations. According to some embodiments, the main distribution frame 209 is configured to send an open circuit alarm signal to the processor 105.

According to some embodiments, the relay 204 comprises a normally closed relay. The relay 204 is powered by the first power source 201 through the solar panel circuit. The relay 204 controls power to one or more circuits, and keeps the circuits open as long as power is applied to the relay 204 from the first power source 201 through the solar panel circuit 113. As a non-limiting example, the relay 204 illustrated in FIG. 2 comprises a double pole single throw relay. A first pole 206 of the relay 204 may control the siren 108, and a second pole 208 of the relay may control an open circuit alarm signal to the main distribution frame 209. Alternatively, two single pole single throw relays may be used. A person of ordinary skill in the art will be capable of selecting an appropriate relay for implementing the disclosed embodiments.

Powering the relay 204 causes the relay poles to remain open, cutting off power to the siren 108 and cutting off the open circuit alarm signal to the main distribution frame 209. If the solar panel circuit 113 is broken, such as by removing one of the solar panels 101*a*, the relay 204 loses power and closes, connecting the siren 108 to the second power source 203, and sending an open circuit alarm signal to the main distribution frame 209. According to some embodiments, the main distribution frame 209 may include a connection to the processor 105. A pushbutton switch 210 may be connected to the solar panel circuit 113 and configured to break the solar panel circuit. According to some embodiments, the pushbutton switch 210 may include a pushbutton with a mushroom head, positive operation of opening contact, and a fixed position. The pushbutton switch 210 may test proper operation of the solar panel circuit 113 and the relay 204. The pushbutton switch 210 and relay 204, including the first pole 206 and second pole 208 may be enclosed in an alarm control box 205. The alarm control box secures the components that enable operation of the solar panel circuit 113 against tampering or damage.

Figure 3:
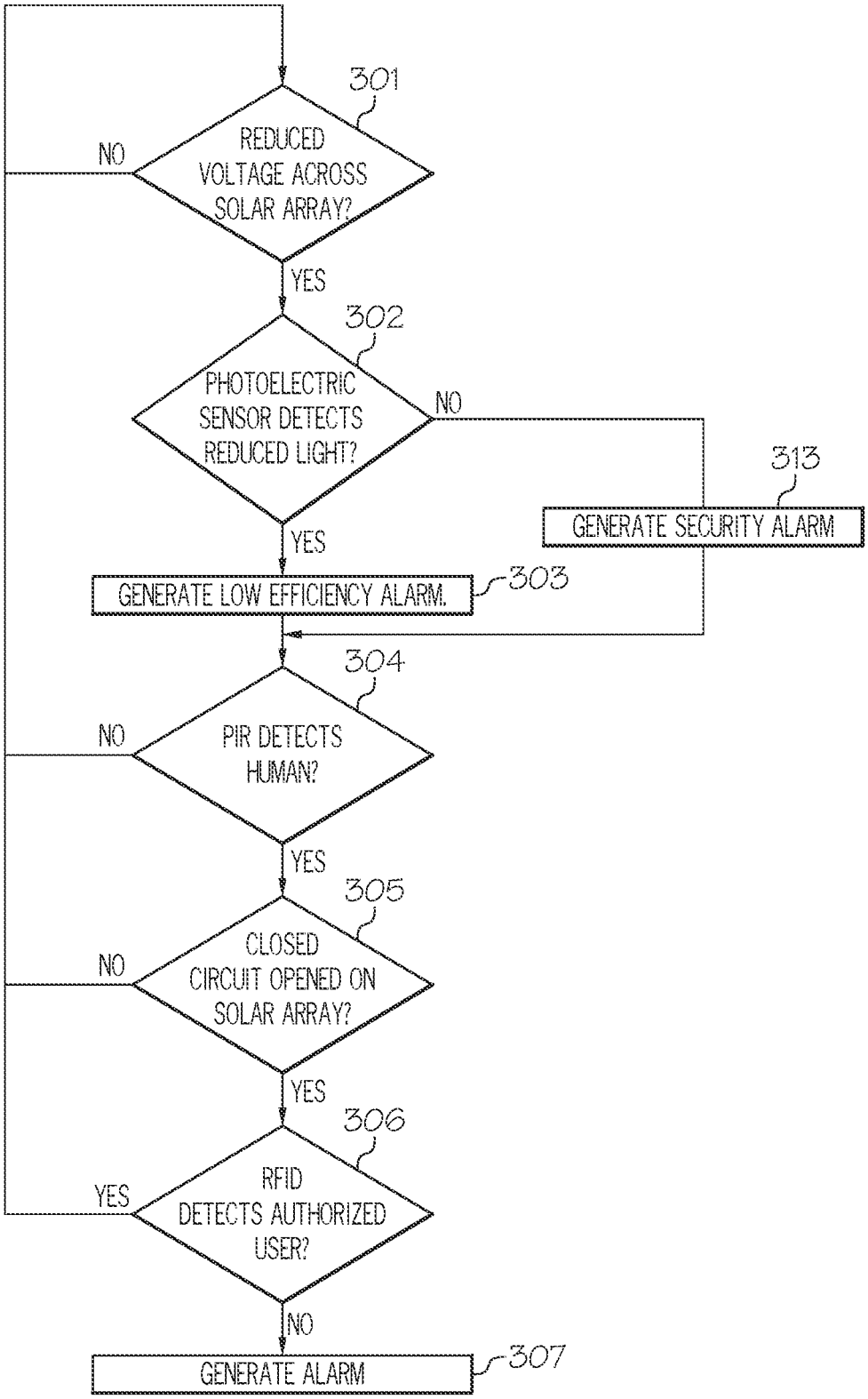
FIG. 3 depicts a flowchart for monitoring solar panel efficiency and security according to one or more embodiments shown and described herein.

FIG. 3 depicts a flowchart for monitoring solar panel efficiency and security according to one or more embodiments shown and described herein. The steps depicted in FIG. 3 may be performed by a computing device comprising a processor and memory or a computing device comprising logic gates. The sequence of the steps in FIG. 3 is for illustration purposes only and the steps need not necessarily be performed in the sequence shown. The computing device may include one or more of the processor 105, the voltage-based monitoring circuit 102, and the closed circuit control 111.

At step 301, the computing device detects the voltage across the solar array 101. According to some embodiments, in response to detecting a reduced voltage across the solar array, the computing device receives the detected light level from the photoelectric sensor 103 at step 302. In response to both a reduced voltage across the solar array and reduced light detected at the photoelectric sensor, the computing device may generate a low-efficiency alarm at step 303. In response to a reduced voltage across the solar array without reduced light detected at the photoelectric sensor, the computing device may generate a security alarm signal at step 313.

At step 304, the PIR sensor 110 detects a human at or near the solar panel array 101, or within the solar array 101 facility. As a non-limiting example of performing steps in a sequence different than that illustrated in FIG. 3, according to some embodiments, in response to detecting a human at step 304, the computing device may use the RFID reader 107 to detect an authorized RFID tag.

At step 305, the computing device detects an opening of the solar panel circuit 113. At step 306, the computing device uses the RFID reader to detect an authorized RFID tag. In response to a reduced voltage across the solar array 101 at step 301 while the detected light level from the photoelectric sensor remains constant, detecting a human at step 304, detecting an open circuit at step 305, and failure to detect an authorized RFID tag at step 306, the computing device generates a master alarm. The computing device may transmit the master alarm to a monitoring center 112.

Figure 4:
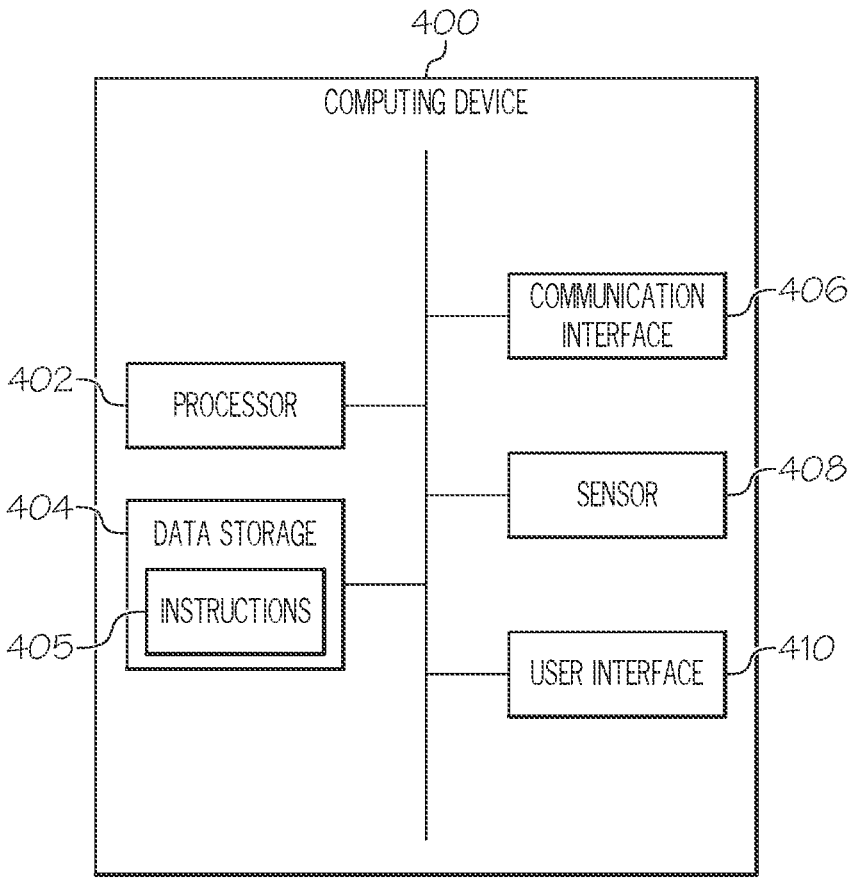
FIG. 4 depicts a block diagram of a computing device, according to one or more embodiments shown and described herein.

FIG. 4 depicts a block diagram of a computing device, according to one or more embodiments shown and described herein. As shown, a computing device 400 may include a processor 402, and data storage 404 including instructions 405. The computing device may further include a communication interface 406, a sensor 408, and a user interface 410, each of which are communicatively connected via a system bus 412. Any component or combination of components of the disclosed embodiments may take the form of or include a computing device 400. It should be understood that computing device 400 may include different and/or additional components, and some or all of the functions of a given component could instead be carried out by one or more different components. Computing device 400 may take the form of (or include) a virtual computing device or one or more computing resources in a cloud computing environment. Additionally, computing device 400 could take the form of (or include) a plurality of computing devices of any form, and some or all of the functions of a given component could be carried out by any combination of one or more of the computing devices in the plurality.

Processor 402 may take the form of one or more general-purpose processors and/or one or more special-purpose processors, and may be integrated in whole or in part with data storage 404, communication interface 406, sensor 408, user interface 410, and/or any other component of computing device 400, as examples. Accordingly, processor 402 may take the form of or include a controller, an integrated circuit, a microchip, a central processing unit (CPU), a microprocessor, a system on a chip (SoC), a field-programmable gate array (FPGA), and/or an application-specific integrated circuit (ASIC), among other possibilities.

Data storage 404 may take the form of a non-transitory computer-readable storage medium such as a hard drive, a solid-state drive, an erasable programmable read-only memory (EPROM), a universal serial bus (USB) storage device, a compact disc read-only memory (CD-ROM) disk, a digital versatile disc (DVD), a relational database management system (RDBMS), any other non-volatile storage, or any combination of these, to name just a few examples.

Instructions 405 may be stored in data storage 404, and may include machine-language instructions executable by processor 402 to cause computing device 400 to perform the computing-device functions described herein. Additionally or alternatively, instructions 405 may include script instructions executable by a script interpreter configured to cause processor 402 and computing device 400 to execute the instructions specified in the script instructions. According to some embodiments, the instructions include instructions executable by the processor to cause the computing device to execute an artificial neural network. It should be understood that instructions 405 may take other forms as well.

Additional data may be stored in data storage 404, such as databases, data structures, data lakes, and/or network parameters of a neural network. The additional data could be stored such as a table, a flat file, data in a file system of the data storage, a heap file, a B+ tree, a hash table, a hash bucket, or any combination of these, as examples.

Communication interface 406 may be any component capable of performing the communication-interface functions described herein, including facilitating wired and/or wireless communication between computing device 400 and another entity. As such, communication interface 406 could take the form of an Ethernet, Wi-Fi, Bluetooth, and/or USB interface, among many other examples. Communication interface 406 may receive data over a network via communication links, for instance.

Sensor 408 could take the form of one or more sensors operable to perform any of the sensor functions described herein, including, but not limited to, the photoelectric sensor 103, the voltage-based monitoring circuit 102, the solar panel circuit 113, the closed circuit control 111, the CCTV 109, the PIR sensor 110 or the RFID reader 107. The sensor could be positioned at any suitable location according to the disclosed embodiments. Though sensor 408 may be referenced in the singular throughout this disclosure, it should be understood that sensor 408 may take the form of (or include) a single sensor or multiple sensors.

User interface 410 may be any component capable of carrying out user-interface functions described herein. For example, the user interface may be configured to receive input from a user and/or output information to the user. Output may be provided via a computer monitor, a loudspeaker (such as a computer speaker), or another component of (or communicatively linked to) computing device 400. User input might be achieved via a keyboard, a mouse, or other component communicatively linked to the computing device. As another possibility, input may be realized via a touchscreen display of the computing device in the form of a smartphone or tablet device. Some components may provide for both input and output, such as the aforementioned touchscreen display. It should be understood that user interface 410 may take numerous other forms as well.

System bus 412 may be any component capable of performing the system-bus functions described herein. In an embodiment, system bus 412 is any component configured to transfer data between processor 402, data storage 404, communication interface 406, sensor 408, user interface 410, and/or any other component of computing device 400. In an embodiment, system bus 412 includes a traditional bus as is known in the art. In other embodiments, system bus 412 includes a serial RS-232 communication link, a USB communication link, and/or an Ethernet communication link, alone or in combination with a traditional computer bus, among numerous other possibilities. In some examples, system bus 412 may be formed from any medium that is capable of transmitting a signal, such as conductive wires, conductive traces, or optical waveguides, among other possibilities.

Moreover, system bus 412 may be formed from a combination of mediums capable of transmitting signals. The system bus could take the form of (or include) an internal data bus of the computing device, a local area network (LAN), communication connections between components of the disclosed embodiments, or any combination of these mediums. It should be understood that system bus 412 may take various other forms as well.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A solar panel monitoring system comprising:

a photoelectric sensor configured to detect a light level at a solar panel;

a voltage-based monitoring circuit configured to:

receive a detected light level from the photoelectric sensor;

monitor a voltage of the solar panel; and generate a security alarm signal in response to detecting a reduced voltage of the solar panel while the detected light level from the photoelectric sensor remains constant;

a solar panel circuit configured to form a closed circuit with the solar panel such that removal of the solar panel opens the closed circuit and generates an open circuit alarm signal;

a PIR sensor configured to output an infrared alarm signal in response to detecting an infrared signal exceeding a predetermined threshold;

an RFID reader configured to detect an authorized RFID tag and generate an unauthorized alarm signal in response to a failure to detect an authorized RFID tag;

a processor configured to, in response to detecting both the security alarm signal and the open circuit alarm signal:

check the output of the PIR sensor;

in response to the infrared alarm signal output by the PIR sensor, detect the unauthorized alarm signal; and in response to detecting the unauthorized alarm signal, transmit a master alarm to a monitoring center.

2. The system of claim 1, wherein the voltage-based monitoring circuit is further configured to generate a low-efficiency alarm in response to detecting the reduced voltage of the solar panel and a reduced detected light level from the photoelectric sensor; and wherein the processor is further configured to transmit the low-efficiency alarm to the monitoring center.

3. The system of claim 2, wherein the voltage-based monitoring circuit is further configured to:

check the detected light level from the photoelectric sensor in response to the detecting of the reduced voltage of the solar panel;

generate the low-efficiency alarm in response to a reduced detected light level; and generate the security alarm signal in response to the detected light level remaining constant while detecting the reduced voltage of the solar panel.

4. The system of claim 1, further comprising:

a camera, wherein the processor is further configured to record images using the camera in response to the infrared alarm signal and detecting the unauthorized alarm signal.

5. The system of claim 1, further comprising:

a siren, wherein the processor is further configured to activate the siren in response to the infrared alarm signal and detecting the unauthorized alarm signal.

6. The system of claim 1, further comprising:

a solar panel regulator configured to connect to the solar panel, wherein the voltage-based monitoring circuit is embedded in the solar panel regulator.

7. A method of monitoring security and efficiency of a solar array, the method comprising:

receiving a detected light level from a photoelectric sensor positioned at the solar array;

detecting a reduced voltage of the solar array;

receiving an open circuit alarm signal of a solar panel circuit configured to form a closed circuit with the solar array;

in response to receiving the open circuit alarm signal and detecting the reduced voltage of the solar panel while the detected light level from the photoelectric sensor remains constant:

detecting an infrared alarm signal of a PIR sensor;

reading an unauthorized alarm signal of an RFID reader in response to detecting the infrared alarm signal output by the PIR sensor; and transmitting a master alarm to a monitoring center, in response to reading the unauthorized alarm signal.

8. The method of claim 7, further comprising:

transmitting a low-efficiency alarm to the monitoring center in response to detecting the reduced voltage of the solar panel and a reduced detected light level from the photoelectric sensor.

9. The method of claim 8, further comprising:

checking the detected light level from the photoelectric sensor in response to the detecting of the reduced voltage of the solar panel;

generating the low-efficiency alarm in response to a reduced detected light level; and generating a security alarm signal in response to detecting the reduced voltage of the solar panel while the detected light level from the photoelectric sensor remains constant.

10. The method of claim 7, further comprising:

recording images using a camera in response to the infrared alarm signal and detecting the unauthorized alarm signal.

11. The method of claim 7, further comprising:

activating a siren in response to the infrared alarm signal and detecting the unauthorized alarm signal.

12. The method of claim 7, further comprising:

using a PIR sensor to detect an infrared signal greater than or equal to a threshold corresponding to a human infrared signal; and generating the infrared alarm signal in response to detecting the infrared signal.

13. The method of claim 7, further comprising:

using an RFID reader to scan for an RFID tag of an authorized user; and generating the unauthorized alarm signal in response to failure to detect the RFID tag of the authorized user.

* * * * *